US011525602B2

(12) United States Patent
Kilgo

(10) Patent No.: US 11,525,602 B2
(45) Date of Patent: Dec. 13, 2022

(54) COVER PANELS FOR CLIMATE CONTROL SYSTEM HOUSINGS AND METHODS RELATED THERETO

(71) Applicant: Trane International Inc., Davidson, NC (US)

(72) Inventor: Richard Kilgo, Whitehouse, TX (US)

(73) Assignee: Trane International Inc., Davidson, NC (US)

( * ) Notice: Subject to any disclaimer, the term of this patent is extended or adjusted under 35 U.S.C. 154(b) by 493 days.

(21) Appl. No.: 16/584,561

(22) Filed: Sep. 26, 2019

(65) Prior Publication Data

US 2021/0095887 A1 Apr. 1, 2021

(51) Int. Cl.

| | |
|---|---|
| ***F25D 19/00*** | (2006.01) |
| ***F24F 13/20*** | (2006.01) |
| ***F28F 9/26*** | (2006.01) |

(52) U.S. Cl.

CPC ..... *F24F 13/20* (2013.01); *F28F 9/26* (2013.01); *F24F 2221/36* (2013.01)

(58) Field of Classification Search

CPC ..... F24F 13/20; F24F 2221/36; F28F 9/26
USPC ..... 62/298
See application file for complete search history.

(56) References Cited

U.S. PATENT DOCUMENTS 4,129,013 A 12/1978 Hine, Jr.
4,474,232 A * 10/1984 Wright ..... F24F 13/22 165/137
4,476,066 A * 10/1984 Gollub ..... H02G 3/0437 403/402
5,277,036 A 1/1994 Dieckmann et al.
D557,395 S * 12/2007 Martin, Sr. ..... D23/355
7,669,641 B2 * 3/2010 Rembold ..... F24F 13/222 165/53
7,793,514 B2 * 9/2010 Rios ..... F24F 13/222 62/291
9,752,833 B2 * 9/2017 Gao ..... F28D 15/04
10,132,572 B2 * 11/2018 Sakamaki ..... F24F 13/222
(Continued)

FOREIGN PATENT DOCUMENTS

CN 105318508 A 2/2016

OTHER PUBLICATIONS

TRANE; "Modular Variable Speed Air Handlers"; Pub. No. 22-1717-10; 2010; 28 pages.

*Primary Examiner* — Claire E Rojohn, III
(74) *Attorney, Agent, or Firm* — Womble Bond Dickinson (US) LLP

(57) ABSTRACT

Methods of coupling a heat exchanger into a climate control system and associated systems are disclosed. In an embodiment, the method includes receiving a housing to receive the heat exchanger. The housing includes a cover panel disposed over an opening that has a projection projecting at least partially into the housing, and a first pair of conduits extending through the cover panel in a first direction. In addition, the method includes removing the cover panel from the opening, flipping the cover panel, extending a second pair of conduits through the cover panel in the first direction, and forming connections between the first pair of refrigerant conduits and the second pair of conduits. Further, the method includes covering the opening in the heat exchanger housing with the cover panel so that the projection of the cover panel projects away from the housing and encloses the connections.

5 Claims, 8 Drawing Sheets

(56) References Cited

U.S. PATENT DOCUMENTS

| | | | | |
|---|---|---|---|---|
| 10,240,853 | B2 * | 3/2019 | Mercer | F28F 17/005 |
| 10,724,761 | B2 * | 7/2020 | McGraw | F24F 1/022 |
| 11,226,110 | B2 * | 1/2022 | DeMonte | F24F 13/24 |
| 11,255,594 | B2 * | 2/2022 | Carlton | F28F 17/005 |
| 2007/0169493 | A1 * | 7/2007 | Rios | F25D 21/14 62/285 |
| 2016/0123682 | A1 * | 5/2016 | Barbely | F24F 1/005 312/236 |

* cited by examiner

COVER PANELS FOR CLIMATE CONTROL SYSTEM HOUSINGS AND METHODS RELATED THERETO

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

A climate control system, such as a heating, ventilation, and air conditioning (HVAC) system, a dehumidification system, a refrigeration system, etc., may circulate a refrigerant so as to control a temperature and/or humidity of an indoor or interior space. The refrigerant is separated from the air flowing within and through the indoor space by one or more conduits (e.g., tubing, coils, etc.). In some circumstances, the refrigerant may be toxic and/or flammable such that a leak of the refrigerant may pose a safety issue. In addition, regardless of the toxicity and/or flammability of the refrigerant, a loss of the refrigerant due to a leak may prevent the climate control system from operating effectively during operations.

BRIEF SUMMARY

Some embodiments disclosed herein are directed to a method of fluidly coupling a heat exchanger into a climate control system. In an embodiment, the method includes (a) receiving a housing configured to receive the heat exchanger. The housing includes a cover panel disposed over an opening in the housing, the cover panel having a projection that projects at least partially into the housing. In addition, the cover includes a first pair of refrigerant conduits extending through the cover panel in a first direction relative to the cover panel. The method also includes (b) removing the cover panel from the opening of the housing, and (c) flipping the cover panel. Further, the method includes (d) extending a second pair of refrigerant conduits through the cover panel in the first direction relative to the cover panel, and (e) forming connections between the first pair of refrigerant conduits and the second pair of conduits after (d). Still further, the method includes (f) covering the opening in the heat exchanger housing with the cover panel so that the projection of the cover panel projects away from the housing and encloses the connections.

Other embodiments disclosed herein are directed to a climate control system. In an embodiment, the climate control system includes a housing comprising an exterior surface and an opening in the exterior surface, a first heat exchanger disposed within the housing, and a first pair of refrigerant conduits extending from the first heat exchanger to a pair of first terminal ends. In addition, the climate control system includes a cover panel configured to be disposed over the opening to form a portion of the exterior surface. The cover panel is configured to be placed in: a first orientation in which the cover panel projects into the opening and the first terminal ends pass through the cover panel, and a second orientation in which the cover panel projects out of the opening and away from the housing and the first terminal ends are enclosed within the housing by the cover panel.

Still other embodiments disclosed herein are directed to a method of fluidly coupling an indoor unit to an outdoor unit of a climate control system. In an embodiment, the method includes (a) removing a cover panel from a first orientation on an exterior surface of an indoor unit housing of the indoor unit, wherein, within the first orientation, terminal ends of a first pair of refrigerant conduits extend out of the indoor unit housing through the cover panel. In addition, the method includes (b) inserting terminal ends of a second pair of refrigerant conduits through the cover panel after (a), wherein the second pair of refrigerant conduits are configured to be fluidly coupled to a heat exchanger of the outdoor unit of the climate control system. Further, the method includes (c) forming a pair of connections between the terminal ends of the first pair of refrigerant conduits and the terminal ends of the second pair of refrigerant conduits after (b). Still further, the method includes (d) attaching the cover panel on the exterior surface of the indoor unit housing after (c) in a second orientation. Within the second orientation, the pair of connections between the terminal ends of the first pair of refrigerant conduits and the terminal ends of the second pair of refrigerant conduits are enclosed by the cover panel and the indoor unit housing.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
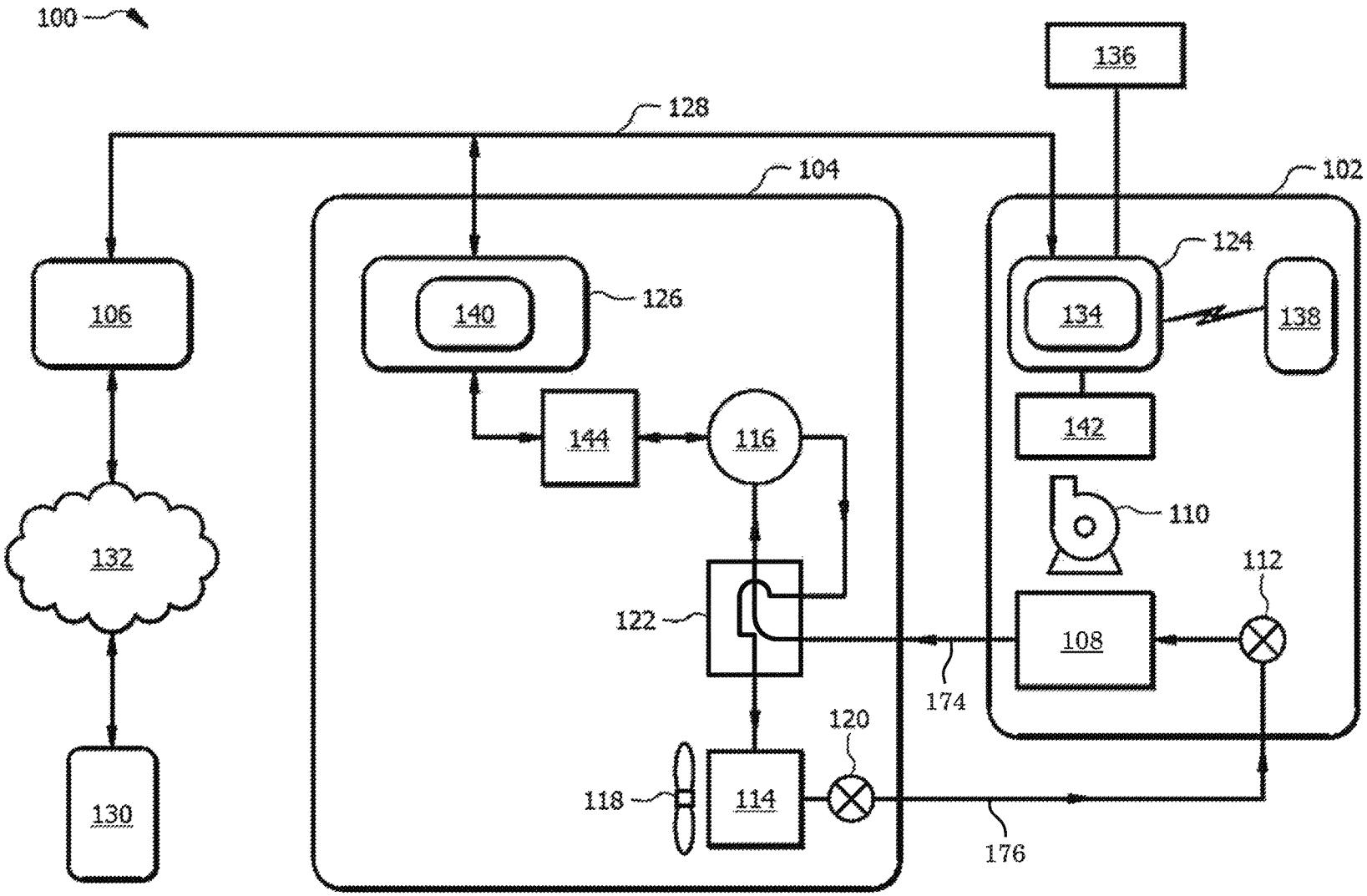
FIG. 1 is a diagram of a HVAC system configured for operating in a cooling mode according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10% unless otherwise stated herein.

As previously described, a leak of refrigerant from a climate control system may be problematic for a number of reasons. As a result, it may be desirable to detect leaks within a climate control system during operations, so as to quickly alert personnel, residents, system controllers, etc. Accordingly, embodiments disclosed herein include systems and methods for facilitating the detection of a refrigerant leak from a climate control system. As described in more detail below, the systems and methods disclosed herein may structurally enclose potential sources of a refrigerant leak and a leak detection assembly within a housing of the climate control system, so as to increase a likelihood that a refrigerant leak from the potential sources will be quickly identified. In addition, in some embodiments the potential leak sources and the leak detection assembly may be enclosed together within the housing with a reversible cover panel that may be transitioned between a pair of orientations so as to also reduce a size of the housing during shipping. Accordingly, through use of the disclosed systems and methods, a refrigerant leak may be detected such that appropriate actions (e.g., repairs, system operations, etc.) may take place so as to avoid or reduce the negative consequences associated with such a leak.

Referring now to FIG. 1, a schematic diagram of a climate control system 100 according to some embodiments is shown. In this embodiment, climate control system 100 is an HVAC system, and thus, system 100 may be referred to herein as HVAC system 100. However, it should be appreciated that the systems and methods disclosed herein may be utilized within a wide variety of climate control systems, such as, for instance, dehumidification systems, refrigeration systems, air conditioning systems, etc. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant (see e.g., airflow 113 in FIGS. 3 and 6-9). In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of an indoor space. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, outdoor unit 104 may comprise an outdoor air handling unit (e.g., such as air unit 150 described below) including outdoor heat exchanger 114 and outdoor fan 118. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages or tubing of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, the outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with HVAC system 100. In some embodiments, the system controller 106 may be configured for selective bidirectional communication over a communication bus 128. In some embodiments, portions of the communication bus 128 may comprise any suitable wired and/or wireless communication path. In some embodiments, the system controller 106 may be configured to selectively communicate with HVAC system 100 components and/or any other device 130 via a communication network 132. In some embodiments, the communication network 132 may comprise a telephone network, the Internet, and/or a remote server and the other device 130 may comprise a telephone, a smartphone and/or other Internet-enabled mobile telecommunication device (e.g., a laptop, tablet computer, etc.).

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication (e.g., communication network 132). In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

As shown in FIG. 1, the HVAC system 100 is configured for operating in a so-called cooling mode in which the refrigerant is circulated through a loop or circuit between the indoor unit 102 an outdoor unit 104 via a plurality of conduits (see e.g., conduits 174, 176 in FIG. 1). In particular, during operations in the cooling mode, heat may generally be absorbed by refrigerant at the indoor heat exchanger 108 and rejected from the refrigerant at the outdoor heat exchanger 114. Starting at the compressor 116, the compressor 116 may be operated to compress refrigerant and pump the relatively high temperature and high pressure compressed refrigerant through the reversing valve 122 and to the outdoor heat exchanger 114, where the refrigerant may transfer heat to an airflow that is passed through and/or into contact with the outdoor heat exchanger 114 by the outdoor fan 118. After exiting the outdoor heat exchanger 114, the refrigerant may flow through and/or bypass the outdoor metering device 120, such that refrigerant flow is not substantially restricted by the outdoor metering device 120. Refrigerant generally exits the outdoor metering device 120 and flows to the indoor metering device 112, which may meter the flow of refrigerant through the indoor metering device 112, such that the refrigerant downstream of the indoor metering device 112 is at a lower pressure than the refrigerant upstream of the indoor metering device 112. From the indoor metering device 112, the refrigerant may enter the indoor heat exchanger 108. As the refrigerant is passed through the indoor heat exchanger 108, heat may be transferred to the refrigerant from an airflow that is passed through and/or into contact with the indoor heat exchanger 108 by the indoor fan 110. Refrigerant leaving the indoor heat exchanger 108 may flow to the reversing valve 122, where the reversing valve 122 may be selectively configured to divert the refrigerant back to the compressor 116, where the refrigeration cycle may begin again.

Figure 2:
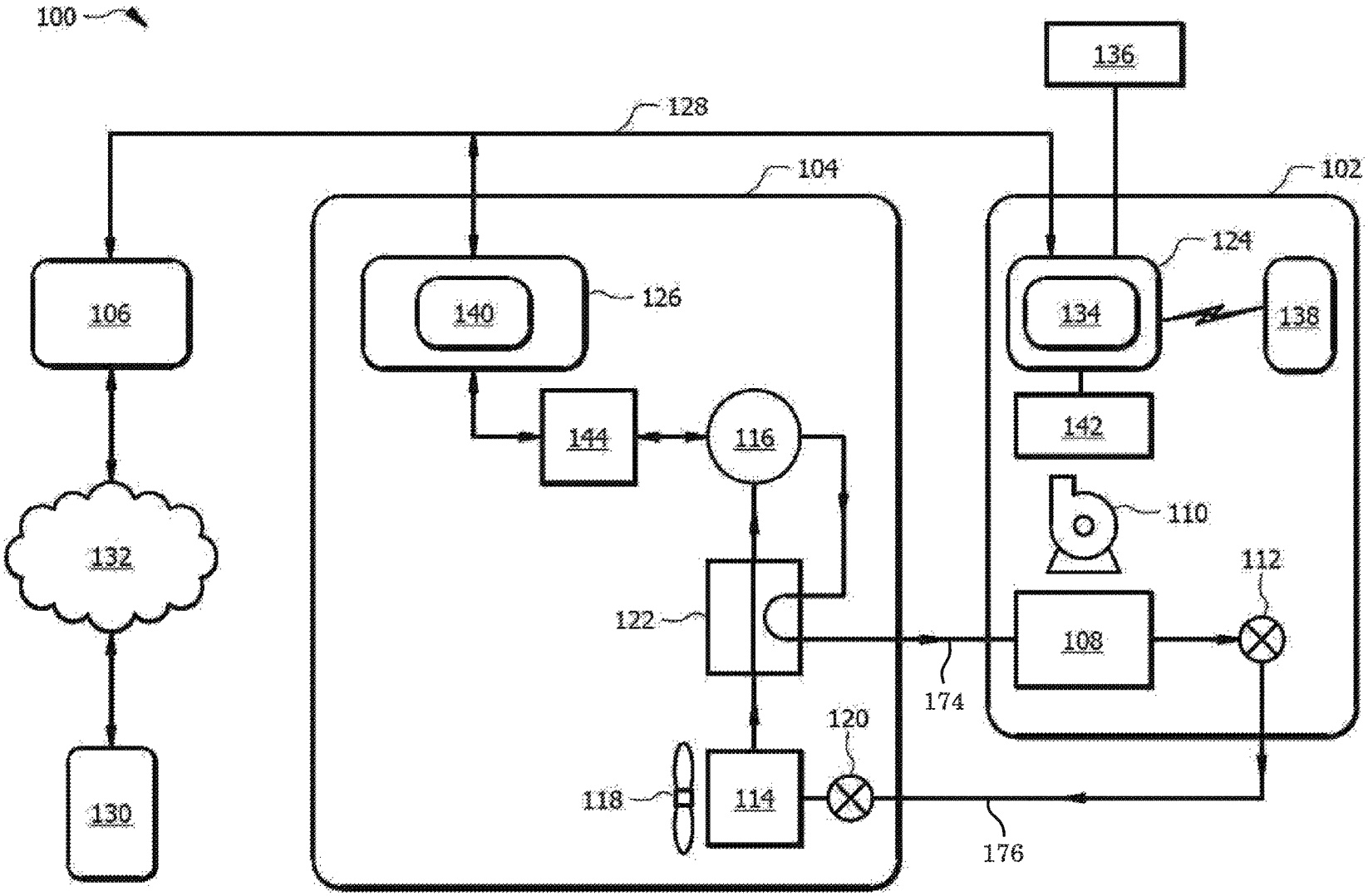
FIG. 2 is a diagram of the HVAC system of FIG. 1 configured for operating in a heating mode according to some embodiments.

Reference is now made to FIG. 2, which shows the HVAC system 100 configured for operating in a so-called heating mode. During operation in the heating mode, refrigerant is again flowed in a loop or circuit between the indoor unit 102 and outdoor unit 104, but the roles of the indoor heat exchanger 108 and the outdoor heat exchanger 114 are reversed as compared to their operation in the above-described cooling mode. For example, the reversing valve 122 may be controlled to alter the flow path of the refrigerant from the compressor 116 to the indoor heat exchanger 108 first and then to the outdoor heat exchanger 114, the outdoor metering device 120 may be enabled, and the indoor metering device 112 may be disabled and/or bypassed. In heating mode, heat may generally be absorbed by refrigerant at the outdoor heat exchanger 114 and rejected by the refrigerant at the indoor heat exchanger 108. As the refrigerant is passed through the outdoor heat exchanger 114, the outdoor fan 118 may be operated to move air into contact with the outdoor heat exchanger 114, thereby transferring heat to the refrigerant from the air surrounding the outdoor heat exchanger 114. Additionally, as refrigerant is passed through the indoor heat exchanger 108, the indoor fan 110 may be operated to move air into contact with the indoor heat exchanger 108, thereby transferring heat from the refrigerant to the air surrounding the indoor heat exchanger 108.

Figure 3:
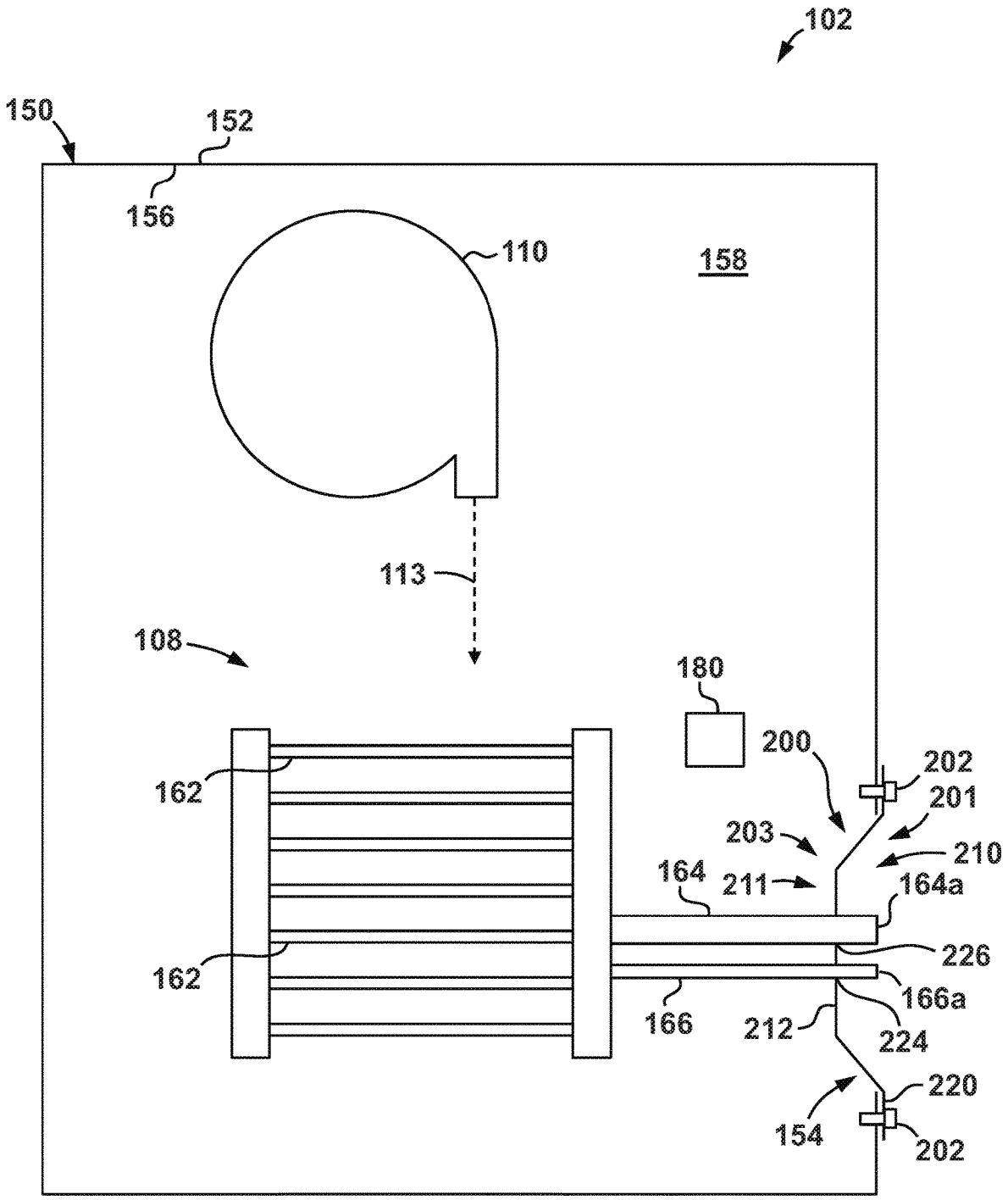
FIG. 3 is a side, partially schematic view of an indoor unit housing of the HVAC system of FIG. 1 including a cover panel according to some embodiments.

Referring now to FIG. 3, indoor unit 102 is shown in more detail according to some embodiments. It should be appreciated that some components of indoor unit 102 (e.g., indoor metering device 112, indoor controller 124, indoor EEV controller 138, indoor fan controller 142, etc. shown in FIGS. 1 and 2) are not shown in FIG. 3 so as to simplify the figure. As shown in FIG. 3, indoor unit 102 includes an indoor unit housing 150 that encloses the indoor fan 110 and indoor heat exchanger 108. In some embodiments, indoor unit housing 150 may comprise a single outer housing that encloses both the indoor fan 110 and the indoor heat exchanger 108 as shown in FIG. 3. In some of these embodiments, one or more partitions or walls may separate the indoor fan 110 and indoor heat exchanger 108 within the single indoor unit housing 150. In other embodiments, the indoor unit housing 150 may enclose the indoor heat exchanger 108, and a second indoor unit housing (not shown) may enclose the indoor fan 110. In some of these embodiments, the second indoor unit housing enclosing the indoor fan 110 may be coupled to the indoor unit housing 150 so that air may flow between the indoor heat exchanger 108 and the indoor fan 110.

The indoor unit housing 150 may comprise an outermost, exterior surface 152 that forms the exterior or outer shape of indoor unit housing 150. Indoor unit housing 150 defines an interior volume 158 that receives the indoor heat exchanger 108 and (in some embodiments) the indoor fan 110. In addition, while not specifically shown, it should be appreciated that interior volume 158 of indoor unit housing 150 may also receive other components of indoor unit 102, such as, for example, indoor metering device 112, indoor controller 124, indoor EEV controller 138, and/or indoor fan controller 142.

An opening 154 is formed through the exterior surface 152 to provide access to interior volume 158. Indoor unit housing 150 may comprise any suitable material, such as, for instance, sheet metal, polymers, composites, etc. In some embodiments, an inner surface 156 of the indoor unit housing 150 may be covered or lined (at least partially) with insulation (not shown) so as to minimize heat transfer through the walls of indoor unit housing 150 during operations.

As shown in FIG. 3, when indoor heat exchanger 108 is disposed within the interior volume 158 of indoor unit housing 150, a first pair of refrigerant conduits 164, 166 may extend out of the interior volume 158, through the opening 154 such that the terminal ends 164*a*, 166*a* of the refrigerant conduits 164, 166 may extend outside of the exterior surface 152. The first pair of refrigerant conduits 164, 166 may be coupled to and extend from the indoor heat exchanger 108. The indoor heat exchanger 108 may also include one or more (e.g., a plurality of) tubes 162 that are fluidly coupled to the first pair of refrigerant conduits 164, 166. As was generally described above, during operation of the HVAC system 100 (see e.g., FIGS. 1 and 2), refrigerant is flowed to the indoor heat exchanger 108 through one of the refrigerant conduits 164, 166. Thereafter, the refrigerant flows through the tubes 162 so as to exchange heat with an airflow 113 that is generated by indoor fan 110 and which flows across the tubes 162. Subsequently, the refrigerant is emitted from the indoor heat exchanger 108 via the other conduit of the pair of the refrigerant conduits 164, 166 (e.g., to the outdoor unit 104 as previously described above). Thus, the first pair of refrigerant conduits 164, 166 may form the inlet and outlet of indoor heat exchanger 108 that may be used connect the tubes 162 to the overall refrigerant loop flowing within the HVAC system 100 (see e.g., FIGS. 1 and 2). In this embodiment, when the HVAC system 100 is operated in the cooling mode (see e.g., FIG. 1), the refrigerant conduit 166 may form the inlet to heat exchanger 108, and the refrigerant conduit 164 may form the outlet of heat exchanger 108. Conversely, when the HVAC system 100 is operated in the heating mode (see e.g., FIG. 2), the refrigerant conduit 164 may form the inlet to heat exchanger 108, and the refrigerant conduit 166 may form the outlet of heat exchanger 108. In some embodiments, one or more components of HVAC system 100 (e.g., indoor metering device 112 shown in FIG. 1) may be fluidly coupled along one of the refrigerant conduits 164, 166 between terminal ends 164*a*, 166*a* and heat exchanger 108.

In addition, it should be appreciated that in some embodiments, there are a plurality of courses or circuits that refrigerant may flow through (e.g., via tubes 162) within the indoor heat exchanger 108. Thus, while not shown, it should be appreciated that one or more manifolds or branch pipes may be included within heat exchanger 108 so as flow the refrigerant along the one or more circuits within heat exchanger 108 during operation. Further, the material of the first pair of refrigerant conduits 164, 166 may be the same or different from the material(s) of tubes 162 (and/or manifolds or other fluid conveyance members within heat exchanger 108).

In the embodiment of FIG. 3, indoor fan 110 emits airflow 113 toward and over the tubes 162 of indoor heat exchanger 108 as generally described above. In this embodiment, indoor fan 110 is upstream of indoor heat exchanger 108 with respect to the direction of airflow 113. However, it should be appreciated that in other embodiments, indoor fan 110 may be disposed downstream of indoor heat exchanger 108 such that airflow 113 is pulled across the tubes 162 by indoor fan 110.

The tubes 162 may generally be constructed of copper, stainless steel, aluminum, and/or another suitable material suitable for promoting heat transfer between the refrigerant carried within the tubes 162 and the airflow 113, during operations (e.g., aluminum, copper, other metallic materials, etc.). In addition, the refrigerant may comprise any suitable heterogeneous or homogeneous fluid that is configured to exchange heat with airflow 113. In some embodiments refrigerant may comprise chlorofluorocarbons, hydrochlorofluorocarbons, hydrofluorocarbons, hydrocarbons, hydrofluoroolefins, etc. In some embodiments, the refrigerant may comprise a flammable material. Some examples of a potentially flammable refrigerants which may be utilized within the embodiments disclosed herein include A2L refrigerants as classified by the American Society of Heating, Refrigeration and Air-Conditioning Engineers (ASHRAE) (e.g., difluoromethane, 1,3,3,3,-tetrafluoropropene etc.).

A refrigerant leak detection assembly 180 may be disposed within interior volume 158 of the indoor unit housing 150. In some embodiments, the leak detection assembly 180 may comprise one or a plurality of sensors that may detect a presence of refrigerant within the interior volume 158 outside of refrigerant conduits 164, 166 and tubes 162. In some embodiments, the leak detection assembly 180 may directly detect the refrigerant (e.g., by sampling the air within the indoor unit housing 150 and potentially determining a concentration of refrigerant therein). In some embodiments, the leak detection assembly 180 may detect an indication of a refrigerant leak (e.g., such as by measuring or detecting some other condition, parameter, etc. that may indicate a refrigerant leak within the indoor unit housing 150). Regardless, during operations leak detection assembly 180 may monitor the interior volume 158 within the indoor unit housing 150 for a leak of the refrigerant.

Referring still to FIG. 3, a cover panel 200 may be disposed over the opening 154 in the exterior surface 152 of indoor unit housing 150. As will be described in more detail below, cover panel 200 may be reversibly coupled to the exterior surface 152 so as to provide a shipment configuration with the cover panel 200 in a first orientation for reducing a size or profile of the exterior surface 152 and an installed configuration with the cover panel 200 in a second orientation for enclosing connections or joints of the refrigerant conduits 164, 166 within the interior volume 158 of indoor unit housing 150 during operations.

Figure 4:
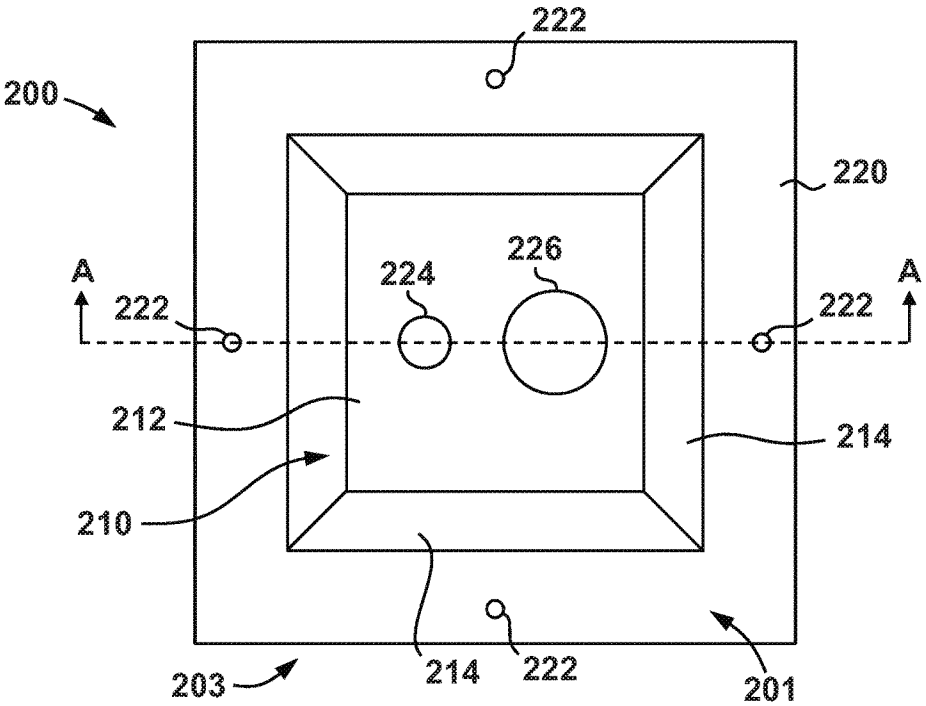
FIG. 4 is a front view of the cover panel of FIG. 3.
Figure 5:
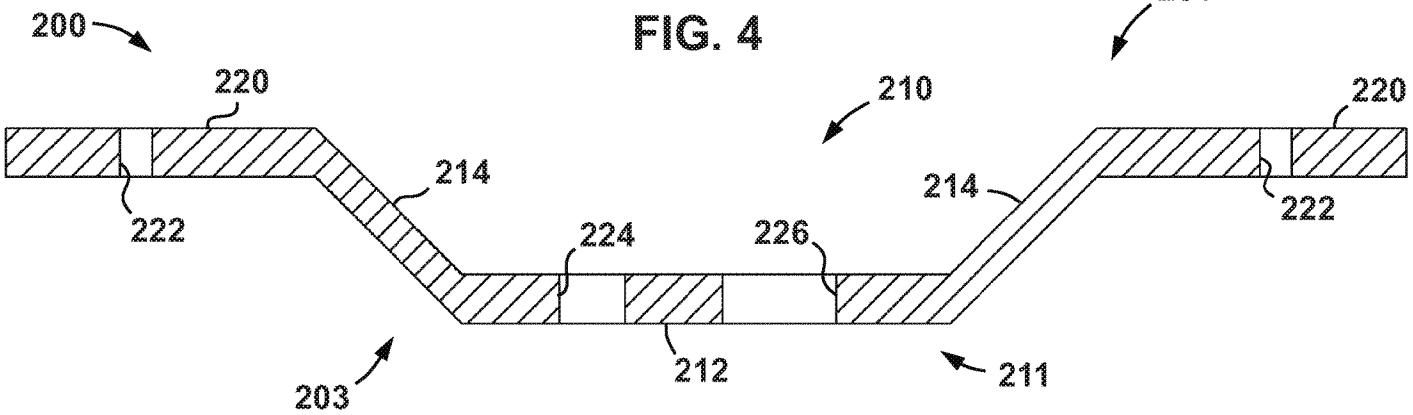
FIG. 5 is a cross-sectional view of the cover panel of FIG. 3 along section A-A in FIG. 4.

Referring now to FIGS. 4 and 5, cover panel 200 may comprise a first side 201, a second side 203 opposite first side 201, a conduit access wall 212, and a perimeter wall 220 disposed about the conduit access wall 212. The conduit access wall 212 is offset from the perimeter wall 220 such that a recess 210 is formed on the first side 201 at the access surface 212 and a projection 211 is formed on the second side 203 at the access surface 212. In one embodiment, the conduit access wall 212 is coupled to the perimeter wall 220 with a plurality angled or tapered walls 214 so that the recess 210 and projection 211 of cover panel 200 are shaped as a truncated pyramid.

A pair of access apertures 224, 226 extend through the conduit access wall 212. As will be described in more detail below, the access apertures 224, 226 are configured to allow passage of refrigerant conduits therethrough during operations.

Referring now to FIGS. 3-5, a plurality of mounting apertures 222 may extend through perimeter wall 220 that may each receive a suitable attachment member 202 (e.g., screw, bolt, nail, rivet, etc.) therethrough during operations. Specifically, as best shown in FIG. 3, attachment members 202 extend through the mounting apertures 222 to secure cover panel 200 to the exterior surface 152 of the indoor unit housing 150, over the opening 154 during operations.

In some embodiments, cover panel 200 may be constructed from a single piece of material (e.g., such as metal).

For instance, in some embodiments, the cover panel 200 may be constructed by pressing a flat or planar piece of sheet metal on an appropriate die so as to form the recess 210 and projection 211 as shown in FIGS. 4 and 5. However, the above described example is merely meant to provide one manufacturing process for cover panel 200, and any suitable material or manufacturing process may be used to form cover panel 200 in other embodiments.

Referring now to FIGS. 3 and 6-9, a method or process is shown for connecting the first pair of refrigerant conduits 164, 166 to the overall refrigerant loop of the HVAC system 100 (see e.g., the fluid loop of HVAC system 100 shown in FIGS. 1 and 2 and generally described above). Referring first to FIG. 3, initially the indoor unit housing 150 may be provided with the cover panel 200 secured over the opening 154 in a first orientation such that second side 203 faces in toward the interior volume 158 of indoor unit housing 150 and the projection 211 extends through the opening 154 into the interior volume 158. The cover panel 200 may be secured over the opening 154 by placing the plurality of attachment members 202 through the mounting apertures 222 extending through the perimeter wall 220 (see FIGS. 4 and 5), and through corresponding apertures in the indoor unit housing 150 that are suitably arranged about the opening 154. Thus, when cover panel 200 is secured over opening 152 in the first orientation, first side 201 forms a portion of exterior surface 152 of indoor unit housing 102.

Without being limited to this or any other theory, this initial configuration shown in FIG. 3, may allow indoor unit housing 150 to assume its smallest outer dimensions, so that packaging and shipment of the indoor unit housing 150 may be simplified and less expensive. Thus, the orientation of cover panel 200 shown in FIG. 3 may be referred to herein as a shipping configuration as mentioned above. In some embodiments, the indoor heat exchanger 108, refrigerant leak detection assembly 180, and/or indoor fan 110 (as well as one or more of the other components of indoor unit 102 in some embodiments) may be pre-installed into the indoor unit housing 150 prior to initially placing the cover panel 200 over the opening in the first orientation shown in FIG. 3, so that the indoor unit housing 150 may be package and shipped with the indoor fan 110 and indoor heat exchanger 108 already disposed therein. In other embodiments, the indoor heat exchanger 108, refrigerant leak detection assembly 180, and/or indoor fan 110 are not disposed within the indoor unit housing 150 before the cover panel 200 is installed over the opening 154 in the first orientation of FIG. 3. As a result, in these embodiments, the indoor heat exchanger 108, refrigerant leak detection assembly 180, and/or indoor fan 110 are delivered to the installation site for the indoor unit (e.g., indoor unit 102 shown in FIG. 2) separately from indoor unit housing 150.

As shown in FIG. 3, when the indoor heat exchanger 108 is installed within interior volume 158 of the indoor unit housing 150, and the cover panel 200 is secured over the opening 154 in the first orientation, the first pair of refrigerant conduits 164, 166 extend through the cover panel 200. More specifically, referring briefly to FIGS. 3-5, the first pair of refrigerant conduits 164, 166 may extend through access apertures 224, 226 in conduit access wall 212 in a first direction that extends from the second side 203 to the first side 201. In this position, the terminal ends 164*a*, 166*a* of the first pair of refrigerant conduits 164, 166, respectively, may be disposed outside, inside, or substantially even with the opening 154 in various embodiments. In some embodiments, the terminal ends 164*a*, 166*a* of the first pair of refrigerant conduits 164, 166, respectively, are disposed at or beyond the exterior surface 152 of the indoor unit housing 102 so that connections may be more readily formed with other refrigerant conduits of the HVAC system 100 as described in more detail below.

Figure 6:
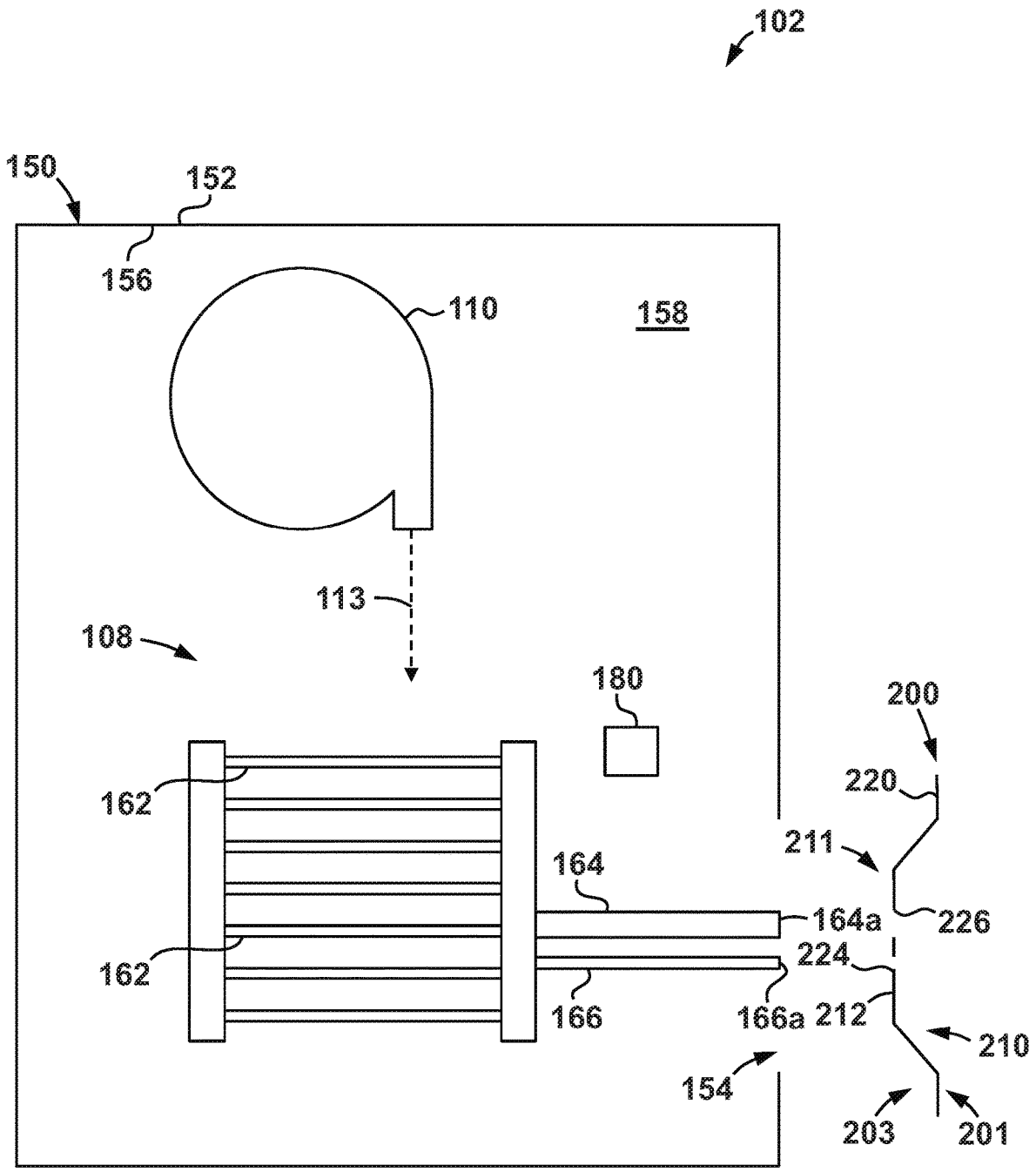
FIGS. 6-9 are sequential side, partially schematic views of a method of fluidly coupling a heat exchanger disposed within the indoor unit housing of FIG. 3 to a refrigerant loop of the HVAC system of FIG. 1 according to some embodiments.

Referring now to FIG. 6, the cover panel 200 may be removed from opening 154, thereby providing access into the interior volume 158. In some embodiments, cover panel 200 may be removed from opening 154 before the installation of indoor heat exchanger 108 within interior volume 158. In other embodiments, cover panel 200 may be removed from opening 154 after heat exchanger 108 is installed within interior volume 158 (e.g., such as when heat exchanger 108 is installed within interior volume 158 prior to shipment of indoor unit 102 as previously described above).

Figure 7:
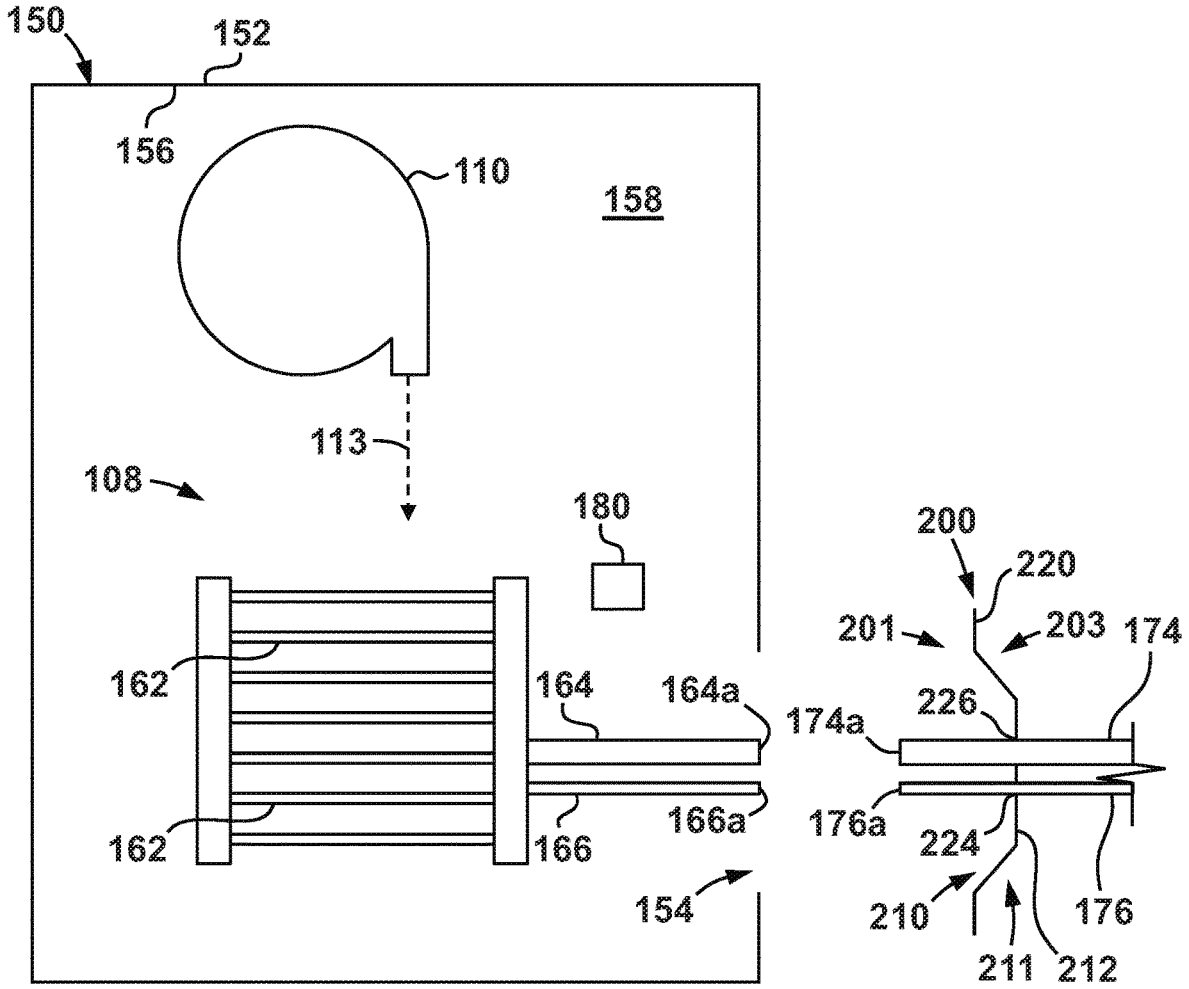

Referring now to FIG. 7, after the cover panel 200 is removed from the opening 154 of the indoor unit housing 150, it may be rotated or flipped from the first orientation to a second orientation in which the cover panel 200 is rotated or flipped 180° from the first orientation. Thereafter, the terminal ends 174*a*, 176*a* of a second pair of refrigerant conduits 174, 176 may be inserted through the access apertures 224, 226 in conduit access wall 212 in the first direction from the second side 203 to the first side 201. Referring briefly to FIGS. 1 and 7, the second pair of refrigerant conduits 174, 176 may fluidly couple the indoor heat exchanger 108 to the outdoor unit 104 so as to complete the refrigerant loop within HVAC system 100 as previously described above.

Figure 8:
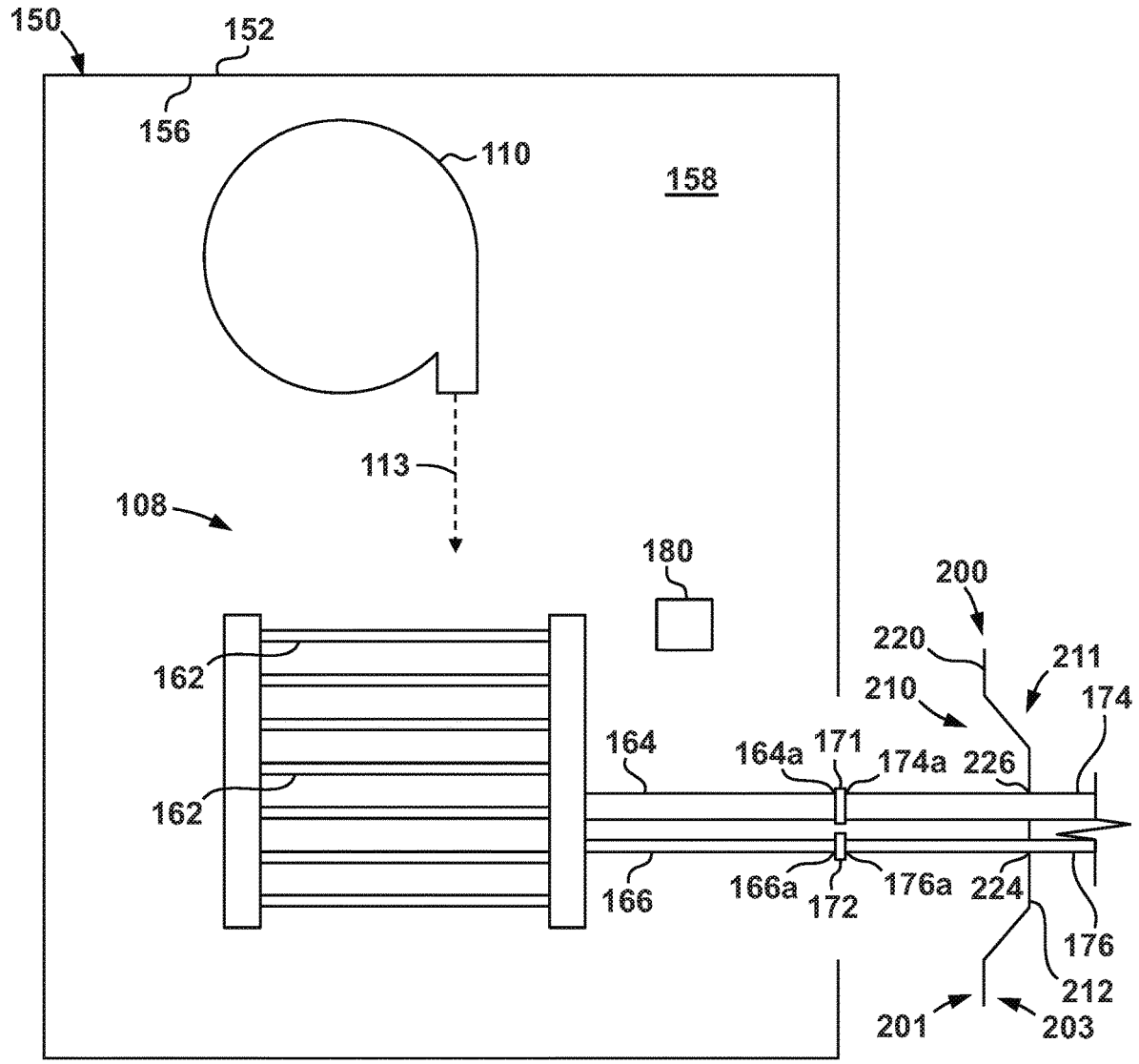

Referring now to FIG. 8, after the terminal ends 174*a*, 176*a* of the second pair of refrigerant conduits 174, 176 are inserted through the conduit access wall 212 (e.g., from the second side 203 to the first side 201 as previously described), the cover panel 200 may be supported by the second pair of refrigerant conduits 174, 176 while the connections 171 and 172 are formed between the terminal ends 164*a*, 174*a* and terminal ends 166*a*, 176*a* of refrigerant conduits 166, 174, and refrigerant conduits 166, 176, respectively. Connections 171, 172 may comprise any suitable connection or mechanism, such as for instance, brazed joints, welded joints, threaded connections, mechanical couplings, flanged couplings, a combination thereof, etc. In some embodiments (e.g., such as the embodiment of FIG. 8), the connections 171, 172 comprise brazed joints. As previously described above, the terminal ends 164*a*, 166*a* of refrigerant conduits 164, 166 may extend to or beyond a plane defined by the exterior surface 152 of indoor unit housing 102. Without being limited to this or any other theory, by extending terminal ends 164*a*, 166*a* of the first pair of conduits 164, 166 beyond or outside of exterior surface 152, an installer may have greater access to terminal ends 164*a*, 166*a* so as to form connections 171, 172 (e.g., such as through brazing as previously described above).

Figure 9:
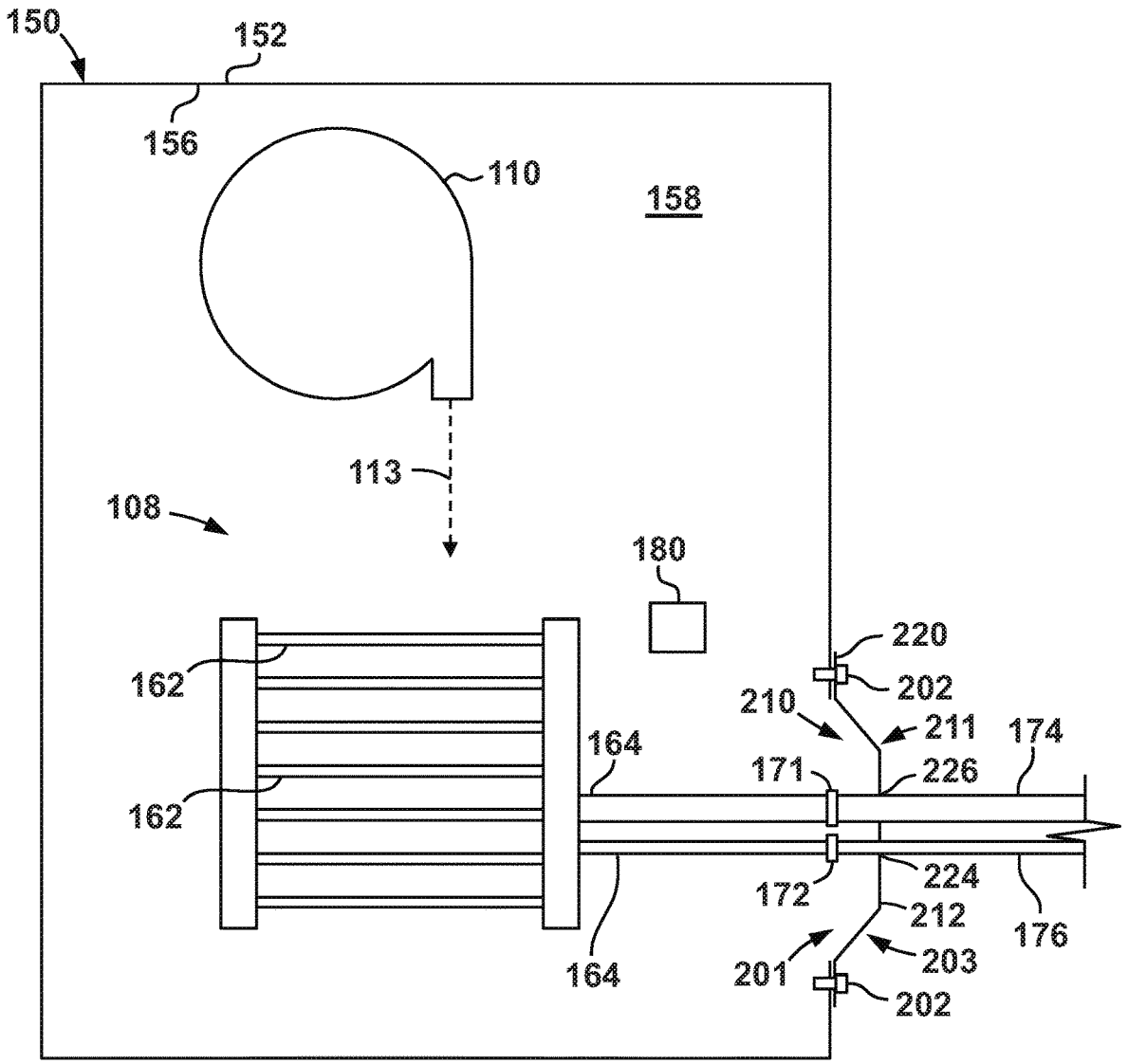

Referring now to FIG. 9, once the connections 171, 172 are formed, the cover panel 200 may be slid along the second pair of refrigerant conduits 174, 176, and then re-secured to the opening 154 via attachment members 202 extending through the mounting apertures 222 in perimeter wall 220 (see e.g., FIGS. 4 and 5) as previously described above. However, as shown in FIG. 9, once the connections 171, 172 are made between the refrigerant conduits 164, 166, 174, 176 as described above, the cover panel 200 may be secured to the indoor unit housing 150 about the opening 154 in the second orientation—namely with the first side 201 facing into the interior volume 158 of indoor unit housing 150 and the second side 203 facing outward or away from the indoor unit housing 150. As a result, the projection 211 may extend away from the opening 154 and exterior surface 152 of the indoor unit housing 150 so as to enclose the connections 171, 172 within the indoor unit housing 150. Thus, by securing the cover panel 200 to indoor unit housing 150 about opening 154, the second side 203 forms a portion of the exterior surface 152, and recess 210 forms a portion of the interior volume 158 (thereby effectively enlarging the interior volume 158).

Without being limited to this or any other theory, the connections 171, 172 between the refrigerant conduits 164, 166, 174, 176 may be a likely leak point for refrigerant during operations. Thus, the cover panel 200 is installed onto the indoor unit housing 150 so as to enclose the connections 171, 172 within the interior volume 158 with the refrigerant leak detection assembly 180. As a result, the refrigerant leak detection assembly 180 may detect refrigerant that is leaking from the connections 171, 172 during operations. In addition, by enclosing the connections 171, 172 within the indoor unit housing 150, the initial leak path for refrigerant from the connections 171, 172 may be contained within the interior volume 158 of indoor unit housing 150, various actions may be taken to mitigate the risks associated with such a leak (e.g., such as when the refrigerant is flammable as described above).

For instance, in some embodiments, if refrigerant leak detection assembly 180 detects that refrigerant is leaking within interior volume 158 of the indoor unit housing 150 (e.g., such as from one or both of the connections 171, 172 as previously described), then a controller of the HVAC system 100 (e.g., controller 106 previously described above) may cause or direct the indoor fan 110 to initiate or increase the airflow 113 via indoor fan 110. In these embodiments, by increasing the speed of airflow 113, the refrigerant leaked into the indoor unit housing 150 may be more quickly diluted. For refrigerants that are flammable (e.g., such as A2L refrigerants described above), a relatively quick dilution is desirable so as to lower the risk of ignition of the refrigerant.

In addition, in some embodiments if a refrigerant leak is detected via the refrigerant leak detection assembly 180, a controller of the HVAC system 100 may slow or stop the operation of a compressor (e.g., such as compressor 116 for HVAC system 100 in FIG. 1), and/or may cause or direct a valve within HVAC system 100 (e.g., such as one or both of the valves 112, 120 of HVAC system 100 in FIG. 1) to close (e.g., partially or fully). In these embodiments, stopping a compressor and/or closing one or more valves of the HVAC system 100 may be aimed at stopping a flow of refrigerant through the indoor heat exchanger 108 so as to isolate the location of the leak (e.g., such as at the connections 171, 172 as previously described).

Further, in some embodiments an alarm may be triggered when the refrigerant leak detection assembly 180 detects a refrigerant leak within the indoor unit housing 150 either in addition to or in lieu of taking other corrective or responsive actions (e.g., such as the corrective or responsive actions described above). The alarm may include an audible and/or visual alarm to alarm persons disposed in and/or near the indoor space to the leak. The alarm may also include an electronic notification sent to one or more controllers or other devices within the HVAC system 100 and/or in a location remote from the climate control system (e.g., such as at a central monitoring station for monitoring operations or operational parameters of the climate control system).

Referring still to FIG. 9, in some embodiments, grommets or other suitable sealing devices (not shown) may be disposed within access apertures 224, 226 about the refrigerant conduits 174,176. During operations, the grommets or other sealing devices may prevent or at least restrict fluid flow into or out of the interior volume 158 between access apertures 224, 226 and refrigerant conduits 174, 176.

Embodiments disclosed herein include systems and methods for facilitating the detection of a refrigerant leak from a climate control system. In particular, the systems and methods disclosed herein include reversible cover panels (e.g., cover panel 200) for a housing of a climate control system (e.g., indoor unit housing 150 of HVAC system 100) that may be transitioned between a pair of orientations so as to reduce a size of the housing during shipping and to enclose one or more refrigerant conduit connections (e.g., connections 171, 172) along with a refrigerant leak detection assembly (e.g., refrigerant leak detection assembly 180) so as to allow more effective detection of refrigerant leaks during operations.

While the cover panel 200 has been described for use on a housing of an indoor unit of a climate control system (e.g., such as indoor unit housing 150), it should be appreciated that embodiments of cover panel 200 may be utilized on any housing of a climate control system that refrigerant conduits may be routed thereto. For instance, cover panel 200 may be utilized in a similar manner for a housing of an outdoor unit of a climate control system (e.g., such as outdoor unit 104 of HVAC system 100 shown in FIGS. 1 and 2). In particular, in some embodiments, cover panel 200 may be used to cover an opening on an enclosure of an outdoor condenser unit of an HVAC system so as to enclose similar connections of refrigerant conduits therein as described above.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A climate control system, comprising:

a housing comprising an exterior surface and an opening in the exterior surface;

a first heat exchanger disposed within the housing;

a first pair of refrigerant conduits extending from the first heat exchanger to a pair of first terminal ends; and a reversible cover panel configured to be disposed over the opening to form a portion of the exterior surface, wherein the cover panel includes a perimeter wall and a conduit access wall, wherein the conduit access wall is offset from the perimeter wall to form a recess on a first side of the cover panel and a projection on an opposite second side of the cover panel, and wherein in a first orientation, the projection of the cover panel extends into the opening and the first terminal ends pass through the cover panel; and wherein in a second orientation, the projection of the cover panel extends out of the opening and away from the housing and the first terminal ends are enclosed within the housing by the cover panel.

2. The climate control system of claim 1, comprising:

a second heat exchanger disposed outside of the housing; and a second pair of refrigerant conduits configured to be fluidly coupled to the second heat exchanger, wherein the second pair of refrigerant conduits comprise second terminal ends, wherein the second terminal ends are coupled to the first terminal ends, such that when the cover panel is in the second orientation, the second pair of refrigerant conduits extend through the cover panel and the second terminal ends are enclosed by the cover panel and the housing.

3. The climate control system of claim 1, wherein in the first orientation, the first side of the cover panel comprising the recess forms the portion of the exterior surface, and wherein in the second orientation, the second side of the cover panel comprising the projection forms the portion of the exterior surface.

4. The climate control system of claim 1, wherein the recess and the projection have a truncated pyramid shape.

5. The climate control system of claim 1, wherein the perimeter wall engages with the exterior surface when the cover panel is in the first orientation and the second orientation.

* * * * *